US007841838B2

(12) United States Patent
Kawabe et al.

(10) Patent No.: US 7,841,838 B2
(45) Date of Patent: Nov. 30, 2010

(54) ROTARY CLOSED TYPE COMPRESSOR AND REFRIGERATING CYCLE APPARATUS

(75) Inventors: Isao Kawabe, Fujinomiya (JP); Kazuo Mochizuki, Fujinomiya (JP); Shoichiro Kitaichi, Fuji (JP); Koji Hirano, Fuji (JP); Izumi Onoda, Fuji (JP); Kazu Takashima, Fuji (JP)

(73) Assignee: Toshiba Carrier Corporation (JP)

( * ) Notice: Subject to any disclaimer, the term of this patent is extended or adjusted under 35 U.S.C. 154(b) by 1038 days.

(21) Appl. No.: 11/222,484

(22) Filed: Sep. 7, 2005

(65) Prior Publication Data

US 2006/0002809 A1 Jan. 5, 2006

Related U.S. Application Data

(63) Continuation of application No. PCT/JP2004/001884, filed on Feb. 19, 2004.

(30) Foreign Application Priority Data

Mar. 18, 2003 (JP) ..... 2003-074250
Sep. 2, 2003 (JP) ..... 2003-310482

(51) Int. Cl.
*F04B 49/00* (2006.01)

(52) U.S. Cl. ..... 417/212; 417/213; 417/214; 418/11; 418/23; 418/60; 418/63; 418/270; 62/172; 62/226

(58) Field of Classification Search ..... 417/212, 417/213, 214; 418/11, 23, 60, 63, 270; 62/172, 62/226

See application file for complete search history.

(56) References Cited

U.S. PATENT DOCUMENTS 3,848,637 A * 11/1974 Wilson ..... 137/625.27
5,050,233 A * 9/1991 Hitosugi et al. ..... 417/427
7,232,291 B2 * 6/2007 Choi et al. ..... 417/298

FOREIGN PATENT DOCUMENTS

| | | |
|---|---|---|
| CN | 11-90160 | 8/1998 |
| JP | 44-9432 | 5/1969 |
| JP | 61-159691 | 10/1986 |

(Continued)

OTHER PUBLICATIONS

Translation of JP 1-247786 from the IDS.*

(Continued)

*Primary Examiner*—Devon C Kramer
*Assistant Examiner*—Christopher Bobish
(74) *Attorney, Agent, or Firm*—DLA Piper LLP (US)

(57) ABSTRACT

A rotary closed type compressor is configured such that an inside of a case becomes high pressure, and the rotary closed type compressor comprises a first cylinder and a second cylinder having cylinder chambers in which eccentric rollers are housed, respectively, vanes which divide the cylinder chamber into two sections, respectively, and vane chambers in which back-face side end portions of the vanes are housed, respectively. The vane on the first cylinder side is pressed and biased by a spring member provided in the vane chamber, and the vane on the second cylinder side is pressed and biased according to pressure difference between case internal pressure introduced to the vane chamber and suction pressure or discharge pressure introduced to the cylinder chamber.

10 Claims, 10 Drawing Sheets

FOREIGN PATENT DOCUMENTS

| | | |
|---|---|---|
| JP | 62-82292 | 4/1987 |
| JP | 62-265484 | 11/1987 |
| JP | 1-247786 | 10/1989 |
| JP | 5-172076 | 7/1993 |
| JP | 10-196568 | 7/1998 |
| JP | 10-259787 | 9/1998 |

OTHER PUBLICATIONS

Translation of JP 61159691 from the IDS.*
Machine translation of JP 10-259787 from IDS.*
Microfilm of the specification and drawings annexed to the request of Japanese Utility Model Application No. 172903/1981, (Laid-Open No. 58-77183) Kabushiki Kaisha General, May 25, 1994.
Microfilm of the specification and drawings annexed to the request of Japanese Utility Model Application No. 42833/1985, (Laid-Open No. 61-159691), Sanyo Electric Co., Ltd., Oct. 3, 1986.
PCT International Preliminary Report on Patentability mailed on Feb. 23, 2006 corresponding to PCT Patent Application No. JP2004/001884.
Official Office Action Letter issued Aug. 10, 2007 in counterpart Chinese application (Application No. 2004800073401), with English language translation.

* cited by examiner

ROTARY CLOSED TYPE COMPRESSOR AND REFRIGERATING CYCLE APPARATUS

CROSS-REFERENCE TO RELATED APPLICATIONS

This is a continuation application of pct application No. PCT/JP2004/001884, filed Feb. 19, 2004, which was published under pct article 21(2) in Japanese.

This application is based upon and claims the benefit of priority from prior Japanese Patent Applications No. 2003-074250, filed Mar. 18, 2003; and No. 2003-310482, filed Sep. 2, 2003, the entire contents of both of which are incorporated herein by reference.

BACKGROUND OF THE INVENTION

1. Field of the Invention

The present invention relates to a rotary closed type compressor constituting a refrigerating cycle of, for example, an air conditioner and a refrigerating cycle apparatus constituting the refrigerating cycle with the rotary closed type compressor.

2. Description of the Related Art

Usually, a rotary closed type compressor has a case internal high-pressure configuration, in which an electric motor unit and a compression mechanism unit coupled to the electric motor unit are housed in a closed case and gas compressed by the compression mechanism unit is temporarily discharged into the closed case. In the compression mechanism unit, an eccentric roller is housed in a cylinder chamber provided in a cylinder. A vane chamber is provided in the cylinder, and a vane is slidably housed in the vane chamber. A leading edge of the vane is always projected onto the cylinder chamber side, and is pressed and biased by a compression spring so as to elastically abut on a circumferential surface of the eccentric roller.

Therefore, the cylinder chamber is divided into two chambers along a rotational direction of the eccentric roller by the vane. A suction unit is communicated with one of two chambers and a discharge unit is communicated with the other chamber. A suction pipe is connected to the suction unit and the discharge unit is opened into the closed chamber.

Recently, a two-cylinder rotary closed type compressor which vertically includes two sets of cylinders is being standardized. When the two-cylinder rotary closed type compressor has one cylinder which always performs compression action and the other cylinder which can switch compression and stop as needed, the compressor has an advantage because the use thereof is wide spread.

For example, there is known a compressor including high-pressure introducing means, in which two cylinder chambers are provided, a vane of one of the cylinder chambers is held while forcibly separated from a roller, and the pressure of the cylinder chamber is increased to interrupt the compression action.

This kind of compressor has extremely excellent function. Since the compressor includes the high-pressure introducing means, however, a high-pressure introducing hole communicating one of the cylinder chambers and the closed case is provided, a two-stage choke mechanism is provided in the refrigerating cycle, a bypass refrigerant pipe which is branched from an intermediate portion of the choke mechanism to communicate with one of the vane chambers is provided, and a solenoid valve is included in a midstream portion of the bypass refrigerant pipe.

Namely, hole-making machining is required in order to form the high-pressure introducing means in the compressor, the choke device on the refrigerating cycle is required to be formed in the two-stage choke mechanism, and the bypass refrigerant pipe is connected between the two-stage choke mechanism and the cylinder chamber. Therefore, the configuration becomes complicated, which adversely affects the cost.

In view of the foregoing, based on the rotary closed type compressor including a first cylinder and a second cylinder, an object of the invention is to provide a rotary closed type compressor, in which a pressing and biasing structure is simplified for the vane of one of the cylinders to reduce the number of components and machining time and reliability is improved, and a refrigerating cycle apparatus including the rotary closed type compressor.

BRIEF SUMMARY OF THE INVENTION

A rotary closed type compressor of the present invention is configured such that an electric motor unit and a rotary compression mechanism unit coupled to the electric motor unit are housed in a closed case and the closed case is caused to be in a high-pressure state by tentatively discharging gas compressed by the compression mechanism unit into the closed case, the compression mechanism unit comprises a first cylinder and a second cylinder having cylinder chambers, respectively, an eccentric roller being housed in the cylinder chamber while being eccentrically rotatable, vanes which are provided in the first cylinder and the second cylinder, respectively, the vane being pressed and biased such that a leading edge of the vane comes into contact with a circumferential surface of the eccentric roller, the vane dividing the cylinder chamber into two sections along a rotating direction of the eccentric roller and vane chambers in which back-face side end portions of the vanes are housed, respectively, the vane provided in the first cylinder is pressed and biased by a sprig member provided in the vane chamber, and the vane provided in the second cylinder is pressed and biased according to pressure difference between case internal pressure introduced to the vane chamber and suction pressure or discharge pressure introduced to the cylinder chamber.

BRIEF DESCRIPTION OF THE SEVERAL VIEWS OF THE DRAWING

FIG. 7 is also a view showing the configuration of the refrigerating cycle.

DETAILED DESCRIPTION OF THE INVENTION

First Embodiment

Figure 1:
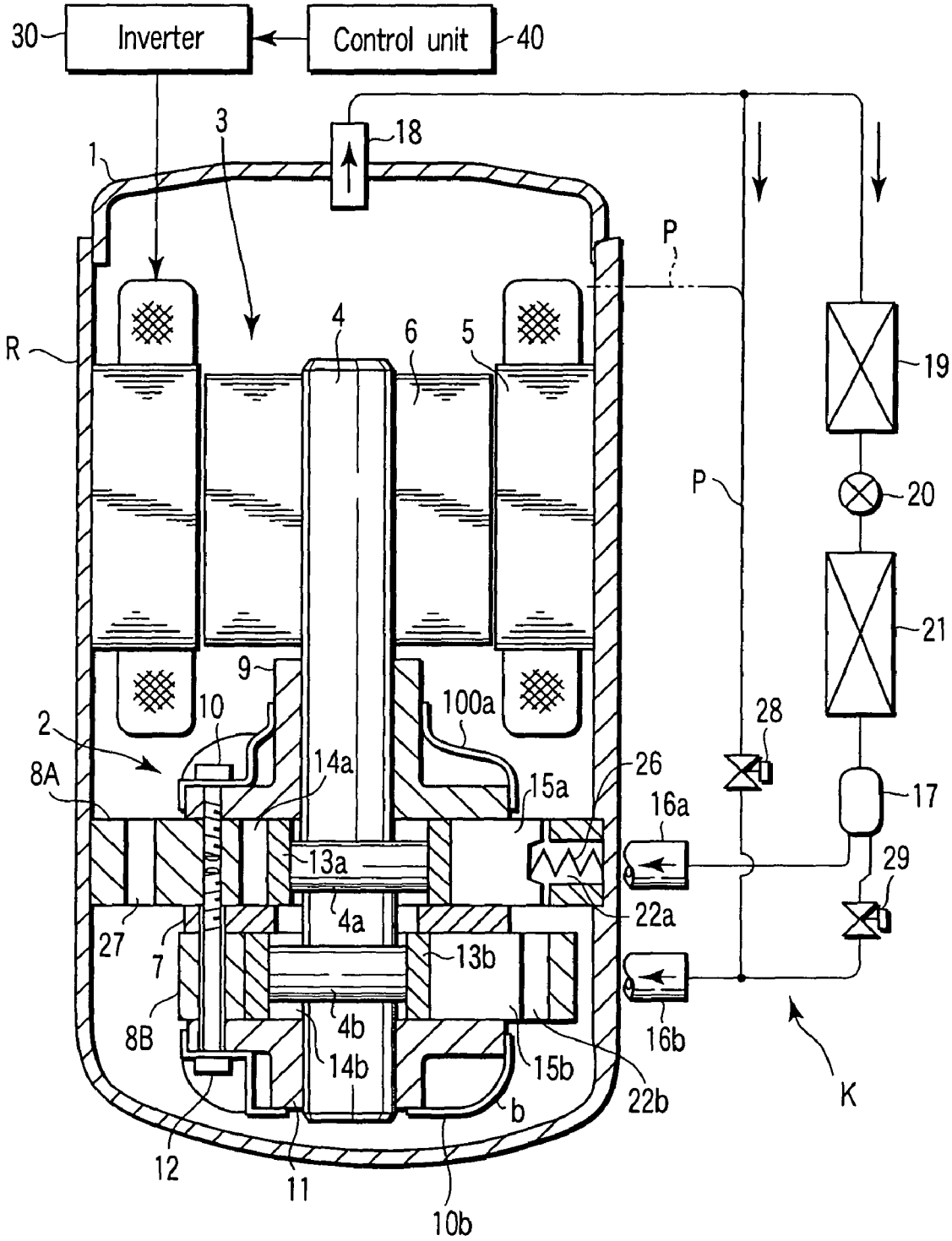
FIG. 1 is a longitudinal sectional view of a rotary closed type compressor according to a first embodiment of the invention, and is also a view showing a configuration of a refrigerating cycle.

Referring now to the drawings, a first embodiment of the invention will be described below. FIG. 1 is a view showing a sectional structure of a rotary closed type compressor R and a configuration of a refrigerating cycle equipped with the rotary closed type compressor R.

First the rotary closed type compressor R will be described. Reference numeral 1 designates a closed case. A later-described compression mechanism unit 2 is provided in a lower portion of the closed case 1, and an electric motor unit 3 is provided in an upper portion of the closed case 1. The electric motor unit 3 and the compression mechanism unit 2 are coupled through a rotating shaft 4.

The electric motor unit 3 includes a stator 5 which is fixed to an inner surface of the closed case 1 and a rotor 6 which is arranged inside the stator 5 while separated from the stator 5 with a predetermined gap, the rotating shaft 4 being inserted into the rotor 6. The electric motor unit 3 is electrically connected to an inverter 30 which can vary the running frequency, and the electric motor unit 3 is also electrically connected to a control unit 40 which controls the inverter 30.

The compression mechanism unit 2 includes a first cylinder 8A and a second cylinder 8B in the lower portion of the rotating shaft 4 while the first cylinder 8A and the second cylinder 8B are vertically provided through an intermediate partition plate 7. The first cylinder 8A and the second cylinder 8B are set such that the first cylinder 8A has the same inner diameter as the second cylinder 8B while the first and second cylinders 8A and 8B differ from each other in external shape and outside dimensions. An outer diameter of the first cylinder 8A is formed so as to be slightly larger than the inner diameter of the closed case 1. The first cylinder 8A is press-fitted into the inner peripheral surface of the closed case 1, and the first cylinder 8A is positioned and fixed by welding from the outside of the closed case 1.

A main bearing 9 is placed on an upper surface of the first cylinder 8A, and the main bearing 9 is attached and fixed to the first cylinder 8A along with a valve cover 100*a* through a bolt 10. A sub-bearing 11 is placed on a lower surface of the second cylinder 8B, and the sub-bearing 11 is attached and fixed to the first cylinder 8A along with a valve cover 100*b* through a bolt 12. The outer diameters of the intermediate partition plate 7 and the sub-bearing 11 are larger than the inner diameter of the second cylinder 8B to an extent, and centers of the outer peripheries of the intermediate partition plate 7 and the sub-bearing 11 are shifted with respect to the center of the inner diameter of the second cylinder 8B. Therefore, part of the outer periphery of the second cylinder 8B is projected in a radial direction from the outer diameters of the intermediate partition plate 7 and the sub-bearing 11.

On the other hand, in the rotating shaft 4, an intermediate portion and a lower end portion are journaled in the main bearing 9 and the sub-bearing 11. The rotating shaft 4 penetrates through the cylinders 8A and 8B, and integrally includes two eccentric portions 4*a* and 4*b* which are formed while a phase difference of 180° exists substantially between the eccentric portions 4*a* and 4*b*. The eccentric portions 4*a* and 4*b* have the same diameter, and are assembled so as to be positioned in each of inner diameter portions of the cylinders 8A and 8B. Eccentric rollers 13*a* and 13*b* are fitted in circumferential surfaces of the eccentric portions 4*a* and 4*b*, respectively.

The first cylinder 8A and the second cylinder 8B are partitioned at the upper surfaces and the lower surfaces by the intermediate partition plate 7 and the main bearing 9 and the sub-bearing 11. Cylinder chambers 14*a* and 14*b* are formed inside the first cylinder 8A and the second cylinder 8B, respectively. The cylinder chambers 14*a* and 14*b* have the same diameter and the same dimension, and the eccentric rollers 13*a* and 13*b* are housed in the cylinder chambers 14*a* and 14*b* while being able to be eccentrically rotated, respectively.

The heights of the eccentric rollers 13*a* and 13*b* are set so as to be substantially equal to the heights of the cylinder chambers 14*a* and 14*b*. Therefore, the eccentric rollers 13*a* and 13*b* are set at the same displacement in the cylinder chamber by the eccentric rotation in the cylinder chambers 14*a* and 14*b* while the phase difference of 180° exists between the eccentric rollers 13*a* and 13*b*. Vane chambers 22*a* and 22*b* communicated with the cylinder chambers 14*a* and 14*b* are provided in the cylinders 8A and 8B, respectively. The vanes 15*a* and 15*b* are housed in the vane chambers 22*a* and 22*b* while retractably moved with respect to the cylinder chambers 14*a* and 14*b*.

Figure 2:
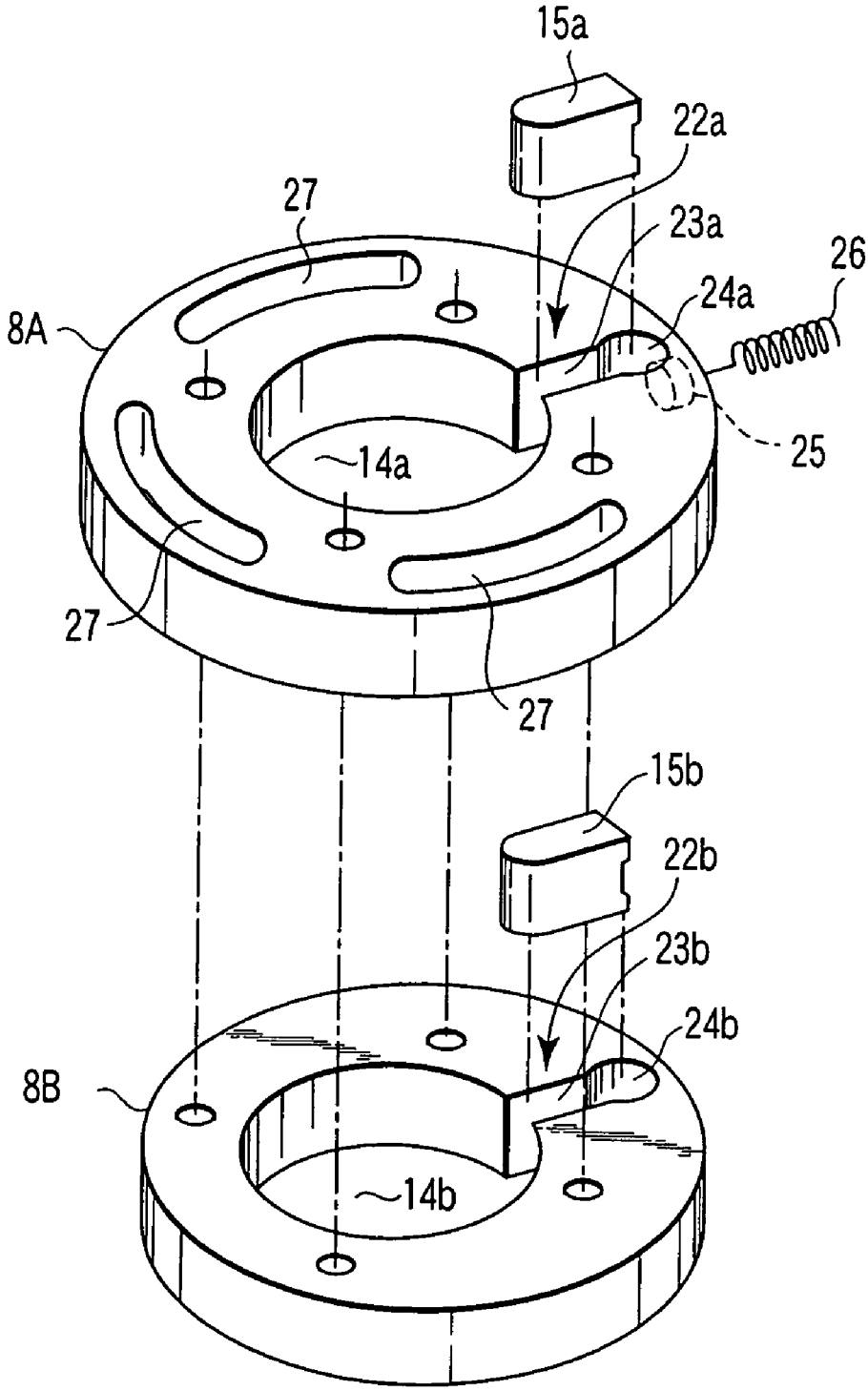
FIG. 2 is an exploded perspective view of a first cylinder and a second cylinder according to the first embodiment.

FIG. 2 is an exploded perspective view showing the first cylinder 8A and the second cylinder 8B.

The vane chambers 22*a* and 22*b* respectively include: vane housing grooves 23*a* and 23*b* in which side faces of the vanes 15*a* and 15*b* can slidably be moved; and longitudinal hole portions 24*a* and 24*b* which are integrally connected to end portions of the vane housing grooves 23*a* and 23*b*, rear end portions of the vanes 15*a* and 15*b* being housed in the longitudinal hole portions 24*a* and 24*b*. A transverse hole 25 communicating the outer peripheral surface and the vane chamber 22*a* is made in the first cylinder 8A, and a spring member 26 is housed in the transverse hole 25. The spring member 26 is placed between an end face on the back face side of the vane 15*a* and the inner peripheral surface of the closed case 1. The spring member 26 is a compression spring which applies elastic force (back pressure) to the vane 15*a* to cause the leading edge of the vane 15*a* to come into contact with the eccentric roller 13*a*.

Any members are not housed in the vane chamber 22*b* on the second cylinder 8B side except for the vane 15*b*. However, as described later, the leading edge of the vane 15*b* is caused to come into contact with the eccentric roller 13*b* according to setting environment of the vane chamber 22*b* and action of a pressure switching mechanism (means) K. The leading edges of the vanes 15*a* and 15*b* are formed in a semi-circle when viewed from a top side. Irrespective of the rotation angle of the eccentric roller 13*a*, the leading edges of the vanes 15*a* and 15*b* can be in point contact with circumferential walls of the eccentric rollers 13*a* and 13*b*, which are formed in the semi-circle when viewed from the top side.

When the eccentric rollers 13*a* and 13*b* are eccentrically rotated along the inner peripheral walls of the cylinder chambers 14*a* and 14*b*, the vanes 15*a* and 15*b* are reciprocally moved along the vane housing grooves 23*a* and 23*b*, and vane rear end portions become movable with respect to the longitudinal hole portions 24*a* and 24*b*. As described above, a part of the outer periphery of the second cylinder 8B is exposed into the closed case 1 due to the relationship between the shape of the outer diameter of the second cylinder 8B and the outer diameters of the intermediate partition plate 7 and the sub-bearing 11.

Because the portion exposed to the closed case 1 is designed to correspond to the vane chamber 22*b*, the vane chamber 22*b* and the rear end portion of the vane 15*b* are directly subjected to internal case pressure. Particularly, although the second cylinder 8B and the vane chamber 22*b* are not affected by the internal case pressure because of the structure, the vane 15*b* is directly subjected to the internal case pressure because the vane 15*b* is slidably housed in the vane chamber 22*b* and the rear end portion of the vane 15*b* is positioned in the longitudinal hole portion 24*b* of the vane chamber 22*b*.

Further, because the front end portion of the vane 15*b* faces the second cylinder chamber 14*b*, the vane front end portion is subjected to the pressure in the second cylinder chamber 14*b*. In the result, the vane 15*b* is configured so as to be moved from the large-pressure direction toward the small-pressure direction according to the difference in pressures between the front end portion and the rear end portion. Attachment holes or screw holes through which the bolts 10 and 12 are inserted are made in the cylinders 8A and 8B, respectively. Arc gas-passing hole portions 27 are made only in the first cylinder 8A.

As shown in FIG. 1, a discharge pipe 18 is connected to an upper end portion of the closed case 1. The discharge pipe 18 is connected to a condenser 19, and is also connected to an accumulator 17 through an expansion mechanism 20 and an evaporator 21. Suction pipes 16*a* and 16*b* for the compressor R are connected to a bottom portion of the accumulator 17. The suction pipe 16*a* penetrates through the closed case 1 and the side portion of the first cylinder 8A, and is directly communicated with the inside of the first cylinder chamber 14*a*. The suction pipe 16*b* penetrates through the side portion of the second cylinder 8B through the closed case 1, and is directly communicated with the inside of the second cylinder chamber 14*b*.

There is also provided a branch pipe P which is branched from a midstream portion of the discharge pipe 18 communicating the compressor R and the condenser 19, and which is merged into the midstream portion of the suction pipe 16*b*. A first on-off valve 28 is provided in the midstream portion of the branch pipe P. A second on-off valve 29 is provided on the upstream side of the branched portion of the branch pipe P in the suction pipe 16*b*. The first on-off valve 28 and the second on-off valve 29 are solenoid valves, which are open-and-close controlled according to an electric signal from the control unit 40.

Thus, the pressure switching mechanism K is formed by the suction pipe 16*b*, the branch pipe P, the first on-off valve 28, and the second on-off valve 29 which are connected to the second cylinder chamber 14*b*. The suction pressure or the discharge pressure is introduced to the second cylinder chamber 14*b* of the second cylinder 8B according to the switching operation of the pressure switching mechanism K.

Then, the action of the refrigerating cycle apparatus equipped with the above-described rotary closed type compressor R will be described.

(1) Case in which Normal Operation (Overall-Capacity Operation) is Selected:

The control unit 40 performs the control so as to open the first on-off valve 28 to open the second on-off valve 29 in the pressure switching mechanism K. Then, the control unit 40 transmits an operation signal to the electric motor unit 3 through the inverter 30. The rotating shaft 4 is rotated, and the eccentric rollers 13*a* and 13*b* are eccentrically rotated in the cylinder chambers 14*a* and 14*b*, respectively.

Because, in the first cylinder 8A, the vane 15*a* is always elastically pressed and biased by the spring member 26, the leading edge of the vane 15*a* is slidably in contact with the circumferential wall of the eccentric roller 13*a* to divide the first cylinder chamber 14*a* into a suction chamber and a compression chamber. A rotational contact point between the eccentric roller 13*a* and the inner peripheral surface of the second cylinder chamber 14*a* corresponds to the vane housing groove 23*a*, and the vane 15*a* retreats farthest. In the state of things, a space capacity becomes the maximum in the cylinder chamber 14*a*. Refrigerant gas is sucked from the accumulator 17 to the upper cylinder chamber 14*a* through the suction pipe 16*a*, and the upper cylinder chamber 14*a* is filled with the refrigerant gas.

The rotational contact point between the eccentric roller 13*a* and the inner peripheral surface of the second cylinder chamber 14*a* is moved in accordance with the eccentric rotation of the eccentric roller 13*a* to decrease the volume of the partitioned compression chamber of the cylinder chamber 14*a*. Namely, the gas previously introduced to the cylinder chamber 14*a* is gradually compressed. The rotating shaft 4 is continuously rotated, which further decreases the volume of the compression chamber of the first cylinder chamber 14*a* to compress the gas. When the pressure in the compression chamber is raised to a predetermined value, a discharge valve (not shown) is opened. The high-pressure gas is discharged into the closed case 1 through the valve cover 100*a*, and the closed case 1 is filled with the high-pressure gas. Then the high-pressure gas is discharged from the discharge pipe 18 located in the upper portion of the closed case 1.

On the other hand, since the first on-off valve 28 constituting the pressure switching mechanism K is closed, the discharge pressure (high pressure) is never introduced to the second cylinder chamber 14*b*. Since the second on-off valve 29 is opened, the low-pressure vaporized refrigerant which is vaporized in the evaporator 21, and gas-liquid separated by the accumulator 17, is introduced to the second cylinder chamber 14*b*. While the second cylinder chamber 14*b* becomes suction pressure (low pressure) atmosphere, the vane chamber 22*b* is exposed to the inside of the closed case 1, and the vane chamber 22*b* becomes discharge (high pressure) atmosphere. In the vane 15*b*, the front end portion becomes the low-pressure condition and the rear end portion becomes the high-pressure condition, which generates pressure difference between the front end portion and the rear end portion.

The front end portion of the vane 15*b* is pressed and biased so as to be slidably in contact with the eccentric roller 13*b* by the influence of the pressure difference. Namely, the completely same compression action as the action that the vane 15*a* on the first cylinder chamber 14*a* side is pressed and biased by the spring member 26 to perform the compression is performed in the second cylinder chamber 14*b*. Finally the overall-capacity operation, in which the compression action is performed by both the first cylinder chamber 14*a* and the second cylinder chamber 14*b*, is performed in the rotary closed type compressor R.

The high-pressure gas discharged from the closed case 1 through the discharge pipe 18 is introduced to the condenser 19, and the high-pressure gas is condensed and liquefied. Then, adiabatic expansion is performed to the high-pressure gas by the expansion mechanism 20, and the high-pressure gas deprives heat exchange air of evaporation latent heat with the evaporator 21 to perform cooling action. After the refrigerant is evaporated, the refrigerant is introduced to the accumulator 17. Then, the gas-liquid separation is performed to the refrigerant, and the refrigerant is sucked from the suction pipes 16*a* and 16*b* into the compression mechanism unit 2 of the compressor R to circulate the above-described path.

(2) Case in which Special Operation (Half-Capacity Operation) is Selected:

When special operation (operation in which compression capacity is decreased to a half) is selected, the control unit 40 performs the switching setting in the pressure switching mechanism K so as to open the first on-off valve 28 and to close the second on-off valve 29. As described above, in the first cylinder chamber 14*a*, the normal compression action is performed and the case 1 is filled with the high-pressure gas discharged into the closed case 1. A part of the high-pressure gas discharged from the discharge pipe 18 is diverged to the branch pipe P and introduced into the second cylinder chamber 14*b* through the opened first on-off valve 28 and the suction pipe 16*b*.

While the second cylinder chamber 14*b* is in the discharge pressure (high pressure) atmosphere, the vane chamber 22*b* is in the same situation as the high pressure of the case 1. Therefore, in the vane 15*b*, the front end portion and the rear end portion are subjected to the high pressure, and the pressure difference does not exist between the front end portion and the rear end portion. The vane 15*b* is not moved, but held in the stopped state at the position separated from the outer peripheral surface of the roller 13*b*, and the compression action is not performed by the second cylinder chamber 14*b*. As a result, only the compression action performed by the first cylinder chamber 14*a* is effective, the operation in which the compression capacity is decreased to the half is performed.

Since the inside of the second cylinder chamber 14*b* becomes the high pressure, leakage of the compressed gas is not generated from the closed case 1 to the second cylinder chamber 14*b*, and loss caused by the compressed gas leakage is also not generated. Therefore, the half-capacity operation can be performed without decreasing compression efficiency. Unlike the conventional art, the compressor according to the first embodiment of the invention does not require such the complicated mechanism that the vane is fixed at a top dead center in the compressor, and the volume can be varied by the simple structure in which the spring member biasing the vane is neglected in the compressor. Therefore, the first embodiment of the invention can provide the capacity-changeable two-cylinder rotary closed type compressor which has a cost advantage, excellent productivity, and high efficiency.

The configuration of the pressure switching mechanism K which switches the suction pressure and the discharge pressure with respect to the second cylinder chamber 14*b* is not limited to the first embodiment, but a modification can be made as follows.

Second Embodiment

Figure 3:
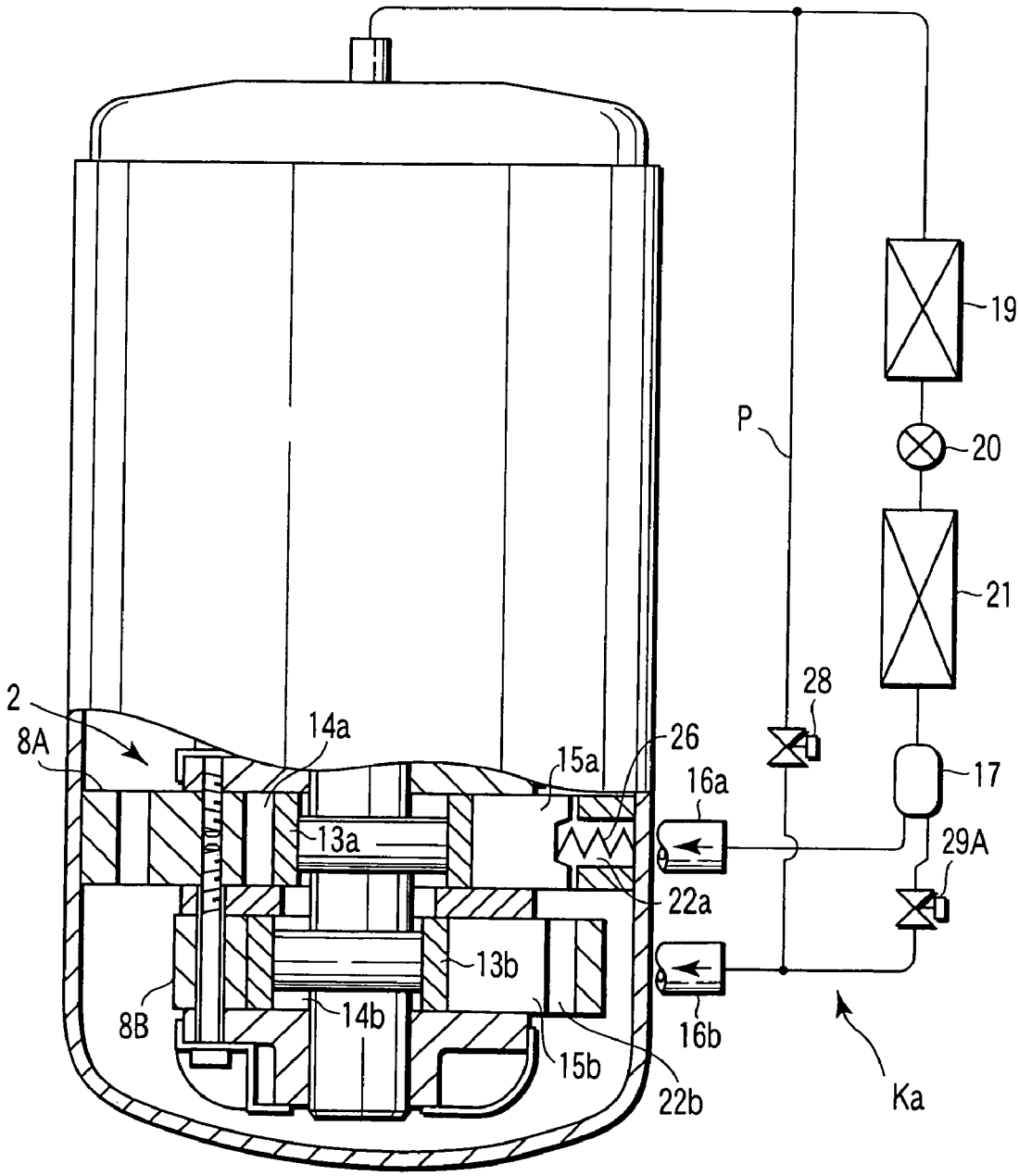
FIG. 3 is a longitudinal sectional view of a rotary closed type compressor according to a second embodiment of the invention, and is also a view showing a configuration of a refrigerating cycle.

FIG. 3 is a view for explaining a configuration of a pressure switching mechanism Ka of a second embodiment. The rotary closed type compressor R and the refrigerating cycle have the same configurations as the above-described first embodiment, they are indicated by the same numerals and the descriptions will be omitted. The pressure switching mechanism Ka has the same configuration as the pressure switching mechanism K in that the branch pipe P equipped with the first on-off valve 28 is connected to a predetermined region. The pressure switching mechanism Ka has the feature in that a check valve 29A is provided instead of the second on-off valve 29. The check valve 29A permits the refrigerant to be passed from the accumulator 17 side to the second cylinder chamber 14*b* side, and the check valve 29A prevents the reverse flow of the refrigerant.

When the overall-capacity operation is selected, the first on-off valve 28 is closed. The low-pressure gas introduced to the suction pipe 16*b* is introduced to the second cylinder chamber 14*b* through the check valve 29A. The second cylinder chamber 14*b* becomes the suction pressure (low pressure), and the vane chamber 22*b* becomes the case internal high pressure, which generates the pressure difference between the front end portion and the rear end portion of the vane 15*b*. The back pressure is applied to the vane 15*b* such that the vane 15*b* is always projected to the second cylinder chamber 14*b*, and the vane 15*b* comes into contact with the eccentric roller 13*b* to perform the compression action. Naturally, the compression action is also performed in the first cylinder chamber 14*a*, so that the overall-capacity operation is performed.

When the half-capacity operation is selected, the first on-off valve 28 is opened. A part of the high-pressure gas guided from the discharge pipe 18 to the branch pipe P is introduced to the second cylinder chamber 14*b* through the first on-off valve 28. While the second cylinder chamber 14*b* becomes the high pressure, the vane chamber 22*b* is also in the high-pressure state, so that the pressure difference does not exist between the front end portion and the rear end portion of the vane 15*b*. Since the position of the vane 15*b* is not changed, the compression action is not performed in the second cylinder chamber 14*b*. As a result, the half-capacity operation in which only the first cylinder chamber 14*a* is effective is performed.

Third Embodiment

Figure 4:
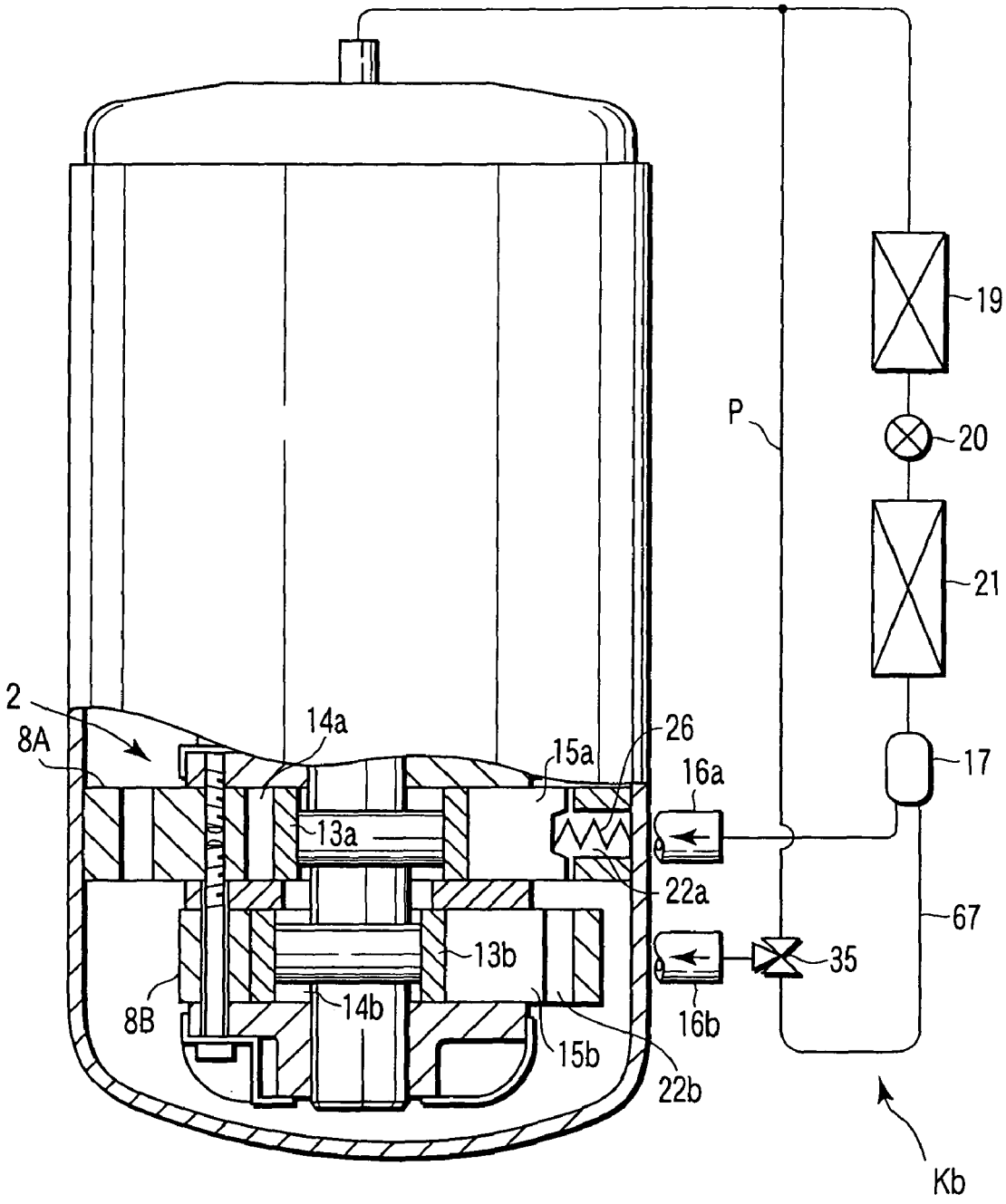
FIG. 4 is a longitudinal sectional view of a rotary closed type compressor according to a third embodiment of the invention, and is also a view showing a configuration of a refrigerating cycle.

FIG. 4 is a view for explaining a configuration of a pressure switching mechanism Kb of a third embodiment. The rotary closed type compressor R and the refrigerating cycle have the same configurations as the above-described first embodiment, they are indicated by the same numerals and the descriptions will be omitted. The pressure switching mechanism Kb includes a three-way selector valve 35 having ports connected to the end portions of the branch pipe P which is branched from the discharge pipe 18, a guide pipe 16 which introduces and guides the low-pressure gas evaporated from the accumulator 17, and a suction pipe 16*b* which is communicated with the suction portion of the second cylinder chamber 14*b*.

When the overall-capacity operation is selected, the three-way selector valve 35 communicates the suction pipe 16 and the second cylinder chamber 14*b*. Therefore, the second cylinder chamber 14*b* becomes the low pressure, which generates the pressure difference between the second cylinder chamber 14*b* and the high-pressure vane 22*b*. The back pressure is applied to the vane 15*b* to cause the vane 15*b* to come into contact with the eccentric roller 13*b*, and the vane 15*b* is reciprocally moved to perform the compression action.

When the half-capacity operation is selected, the three-way selector valve 35 communicates the branch pipe P and the second cylinder chamber 14*b*. The second cylinder chamber 14*b* becomes the high pressure, and the second cylinder chamber 14*b* becomes the same pressure as the high-pressure vane chamber 22*b*, so that the vane 15*b* is not moved. As a result, the half-capacity operation in which only the first cylinder chamber 14*a* is effective is performed.

Fourth Embodiment

Figure 5:
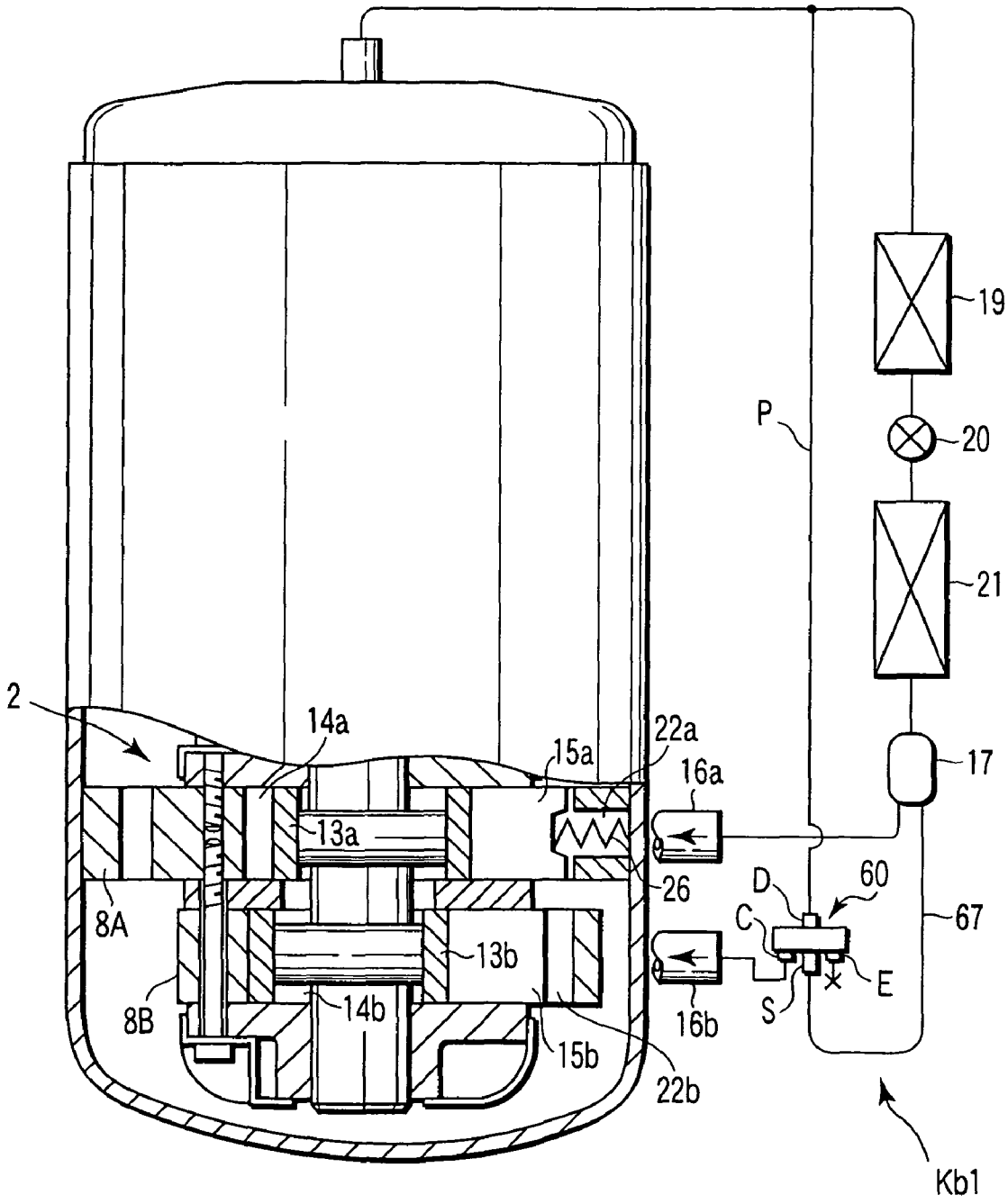
FIG. 5 is a longitudinal sectional view of a rotary closed type compressor according to a fourth embodiment of the invention, and is also a view showing a configuration of a refrigerating cycle.

FIG. 5 is a view for explaining a configuration of a pressure switching mechanism Kb1 of a fourth embodiment. The rotary closed type compressor R and the refrigerating cycle have the same configurations as the above-described first embodiment, they are indicated by the same numerals and the descriptions will be omitted. The pressure switching mechanism Kb1 includes a four-way selector valve 60 instead of the three-way selector valve 35. For example, a four-way selector valve for use in switching the cooling operation and the heating operation in a heat-pump type refrigerating cycle apparatus can directly be adopted as the four-way selector valve 60.

There are connected to the four-way selector valve 60: a high-pressure pipe D which is connected to the branch pipe P branched from the high-pressure side of the refrigerating cycle; a low-pressure pipe S which is connected to the guide pipe 16 which derives the evaporated low-pressure gas through the accumulator 17; a first conduit S which is connected to the suction pipe 16*b* communicated with the second cylinder chamber 14*b*; and a second conduit E which is completely closed by fitting a tap body Z into an opening portion at a front end of the second conduit E.

Figure 6:
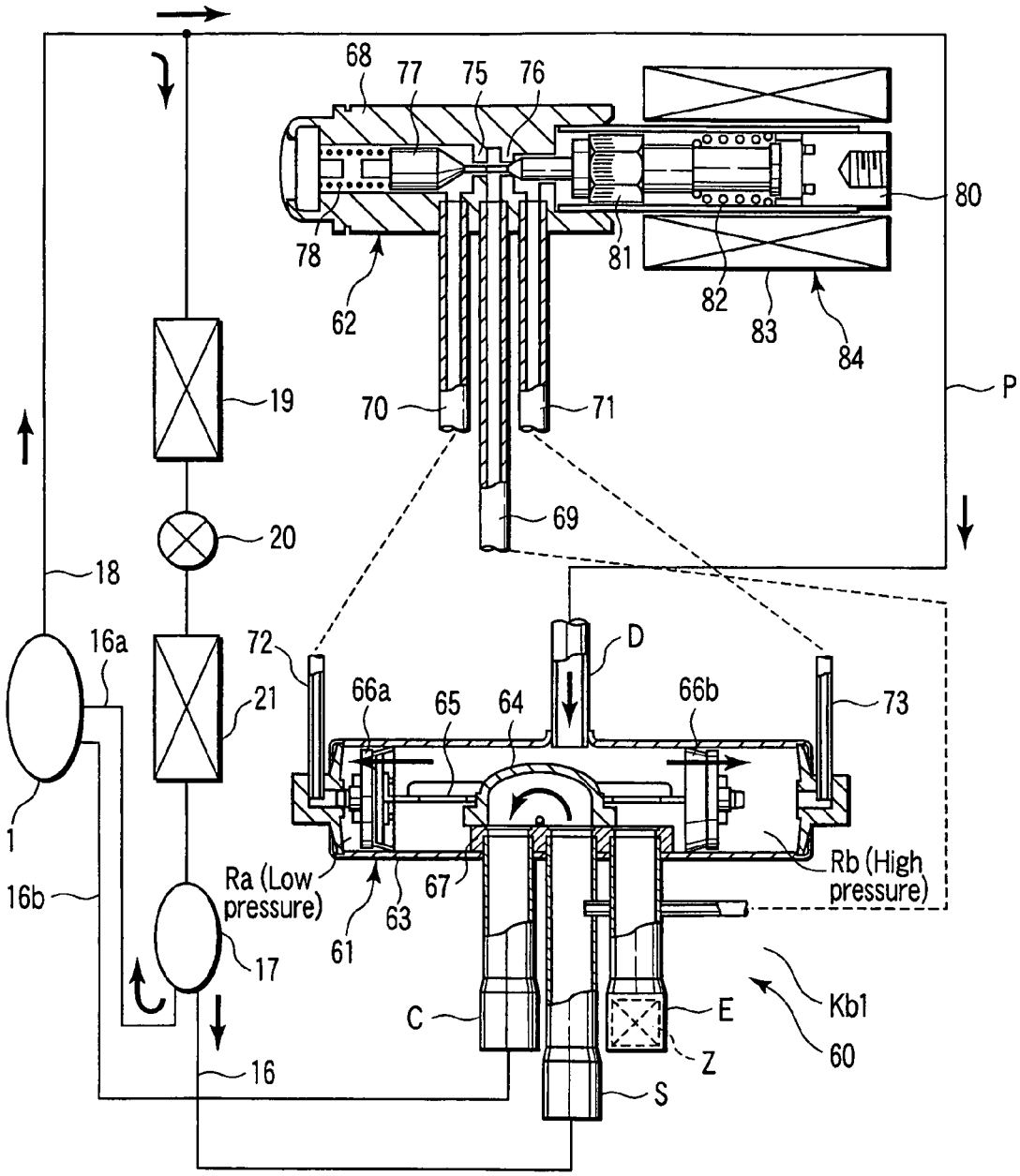
FIG. 6 is a view showing a configuration of a four-way selector valve according to the fourth embodiment, and is also a view showing a configuration of a refrigerating cycle.
Figure 7:
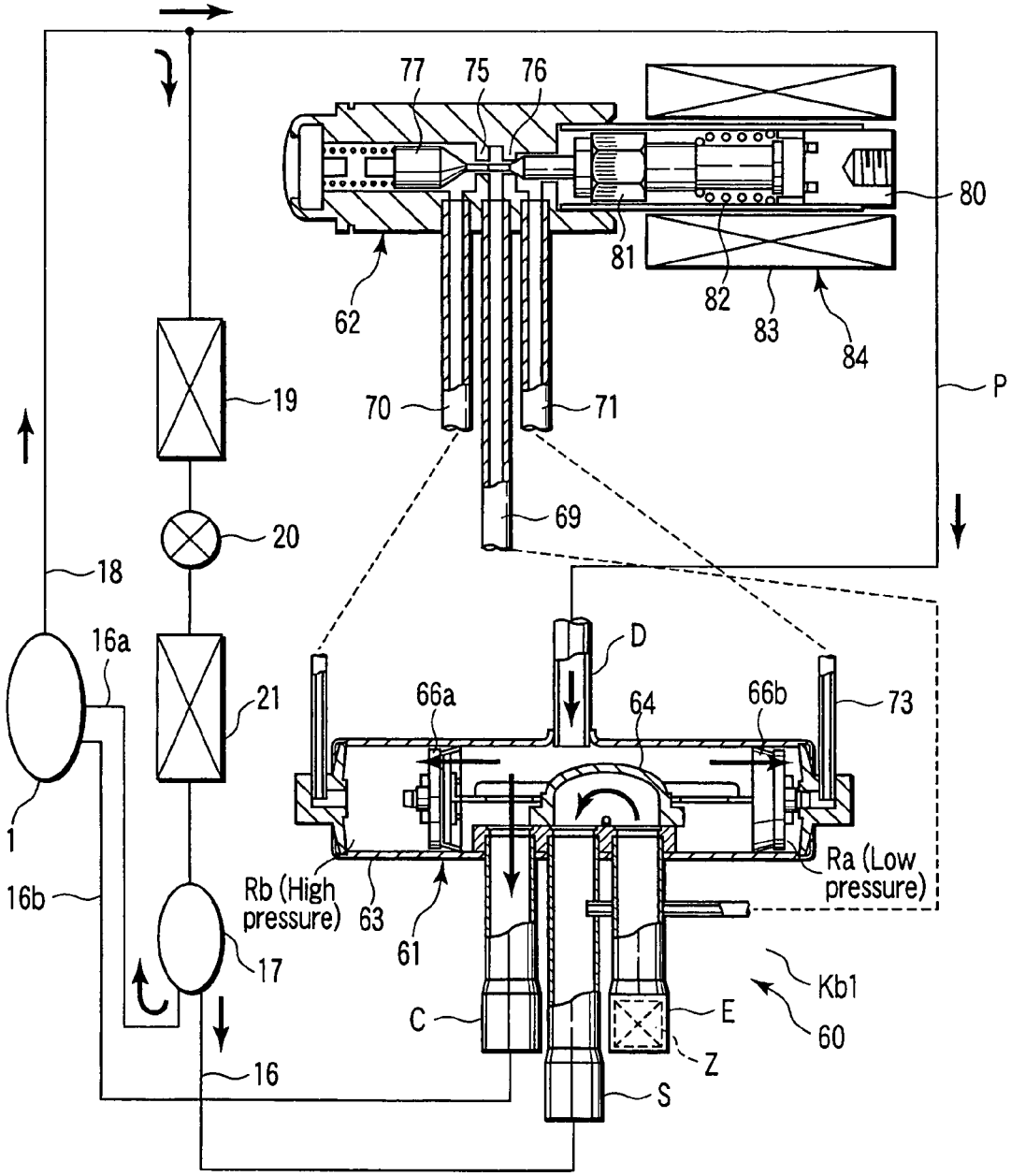
FIG. 7 is a view showing the configuration of the four-way selector valve according to the fourth embodiment which is in a state different from FIG. 6.

The specific configuration of the four-way selector valve 60 will be described in detail. FIGS. 6 and 7 are views showing the configuration of the four-way selector valve 60 and different action states. Although the configurations of the refrigerating cycle shown in FIGS. 6 and 7 differ from the configurations shown in FIGS. 1 to 3 in the illustration manner, the contents of the configurations shown in FIGS. 6 and 7 are the completely same as those of the configurations shown in FIGS. 1 to 3.

The four-way selector valve 60 includes a main valve 61 and a sub-valve (also referred to as pilot valve). In FIG. 5, only the main valve 61 is shown in the four-way selector valve 60. The main valve 61 has a cylindrical valve casing 63 whose both ends are closed. The high-pressure pipe D is connected to the intermediate portion of the valve casing 63, and the low-pressure pipe S is connected in the region which is located across the valve casing from the high-pressure pipe D. The pair of conduits C and E is connected on the both sides of the low-pressure pipe S at the same predetermined intervals. In this case, the conduit located on the left side is referred to as the first conduit C, and the conduit located on the right side is referred to as the second conduit D.

A valve body 64 is housed in the valve casing 63 while being movable along the axial direction of the valve casing 63, and pistons 66*a* and 66*b* are connected on the both side portions of the valve body 64 through a connecting rod 65. The pistons 66*a* and 66*b* are slidably housed in the inner wall of the valve casing 63, and the pistons 66*a* and 66*b* are slidable along the axial direction of the valve casing 63. Pores (not shown) are made in the pistons 66*a* and 66*b*, and the gas can be passed through at the both end portions of the pistons 66*a* and 66*b*.

The valve body 64 can be moved along a valve seat 67 provided in the valve casing 63. The opening ends of the first conduit C, the low-pressure pipe S, and the second conduit E are fitted in the valve seat 67. The valve body 64 is configured to be able to communicate the first conduit C and the low-pressure pipe S according to the position or to be able to communicate the low-pressure pipe S and the second conduit E.

The sub-valve 62 includes a cylindrical sub-valve main body 68, and the sub-valve main body 68 is connected to a low-pressure capillary 69 communicated with the midstream portion of the low-pressure pipe S. A pair of sub-valve capillaries 70 and 71 is connected to the both sides in the axial direction of the sub-valve main body 68 centering about the low-pressure capillary 69. The sub-valve capillaries 70 and 71 are connected to main-valve capillaries 72 and 73 provided on the both ends of the main valve 61, respectively.

Valve seats 75 and 76 which communicate the low-pressure capillary 69 and the left and right sub-valve capillaries 70 and 71, respectively, are formed in the sub-valve main body 68. At one end of the sub-valve main body 68, a needle valve 77 which opens and closes the valve seats 75 and 76 is arranged while being movable along the axial direction, and a spring 78 which biases the needle valve 77 toward the valve seats 75 and 76 is arranged. A solenoid 84 is provided at the other end of the sub-valve main body 68, the solenoid 84 including a fixed iron core 80, a movable iron core 81, a spring 82, and a magnet coil 83.

FIG. 6 shows a non-conductive state to the solenoid 84. The biasing force of the spring 82 presses the movable iron core 81 and the needle valve 77, and the movable iron core 81 and the needle valve 77 are moved leftward. Therefore, the other valve seat 76 (right side) is closed while the valve seat 75 (left side) is opened, and the left-side sub-valve capillary 70 and the low-pressure capillary 69 are communicated with each other. At this point, in the main valve 61, the high-pressure gas is introduced from the high-pressure pipe D into the main-valve valve casing 63, and the valve casing 63 is filled with the high-pressure gas.

The high-pressure gas is introduced to space chambers Ra and Rb through the pores provided in the pair of the left and right pistons 66*a* and 66*b*. The space chambers Ra and Rb are formed between the pistons 66*a* and 66*b* and the end faces of the valve casing 63, respectively. Since, in the sub-valve 62, the valve seat 76 (right side) is closed by the needle valve 77, the high-pressure gas with which the space chamber Rb (right side) is filled stays in the space chamber Rb of the main valve 61, and thereby the space chamber Rb becomes the high-pressure atmosphere.

On the other hand, in the sub-valve 62, on the side of the valve seat 75 which is opened by the needle valve 77, the space chamber Ra (left side) of the main valve 61 and the main-valve capillary 72 are communicated with each other by communicating the low-pressure capillary 69 and the sub-valve capillary 70, and thereby the space chamber Ra becomes the low-pressure atmosphere. Then, pressure difference is generated between the space chambers Ra and Rb located on the both sides in the main valve 61, which allows the valve body 64 to be moved leftward along with the pistons 66*a* and 66*b*. The low-pressure pipe S and the first conduit C are communicated with each other through the valve body 64, and the high-pressure pipe D and the second conduit E are communicated with each other through the valve casing 63.

When electric current is passed through the solenoid 84 of the sub-valve 62, the state shown in FIG. 6 is changed to the state shown in FIG. 7. The movable iron core 81 constituting the solenoid 84 is attracted to the fixed iron core 80, and the movable iron core 81 is moved rightward. Then, the valve seat 75 is closed, and the valve seat 76 is opened, which causes the low-pressure capillary 69 and the sub-valve capillary 71 to communicate with each other. Therefore, in the main valve 61, the one space chamber Rb becomes the low-pressure atmosphere, and the other space chamber Ra which is communicated with the sub-capillary 70 closed by the needle valve 77 becomes the high-pressure atmosphere. The pressure difference is generated between the space chambers Ra and Rb located on the both sides of the main valve 61, and the valve body 64 is moved rightward along with the pistons 66*a* and 66*b*. Accordingly, the low-pressure pipe S and the second conduit E are communicated with each other through the valve body 64, and the high-pressure pipe D and the first conduit C are communicated with each other through the valve casing 63.

In the refrigerating cycle apparatus including the four-way selector valve 60 constituting the above-described pressure switching mechanism Kb1, the solenoid 84 of the sub-valve 62 becomes the non-conductive state when the overall-capacity operation is selected. As shown in FIG. 6, the sub-valve 62 controls the valve body 64 in the main valve 61 such that the low-pressure pipe S and the first conduit C are communicated with each other. Accordingly, the low-pressure pipe S is communicated with the accumulator 17 through the suction pipe 16, and the first conduit C is communicated with the second cylinder chamber 14*b* through the suction pipe 16*b*.

The low-pressure gas is introduced to the second cylinder chamber 14*b*, which generates the pressure difference between the high-pressure vane chamber 22*b* and the second cylinder chamber 14*b*. The back pressure is applied to the vane 15*b* to cause the vane 15*b* to come into contact with the eccentric roller 13*b*, and the vane 15*b* is reciprocally moved to perform the compression action. Naturally, since the compression movement is performed even in the first cylinder chamber 14*a*, the overall-capacity operation is performed by two cylinders.

In the main valve 61 constituting the four-way selector valve 60, the branch pipe P branched from the high-pressure side of the refrigerating cycle and the second conduit E connected to the valve casing 63 are communicated with each other through the valve casing 63, which introduces the high-pressure gas with which the valve casing 63 is filled to the second conduit E. However, since the second conduit E is closed by fitting the tap body Z in the second conduit E, the high-pressure gas is not introduced forward from the second conduit E.

When the half-capacity operation is selected, the solenoid 84 of the sub-valve 62 becomes the conductive state. As shown in FIG. 7, the sub-valve 62 controls the valve body 64 in the main valve 61 such that the low-pressure pipe S and the second conduit E are communicated with each other. The low-pressure pipe S is communicated with the accumulator 17 through the suction pipe 16. However, since the second conduit E is always closed, the low-pressure gas is never introduced forward from the four-way selector valve 60.

On the other hand, the high-pressure pipe D and the first conduit C are communicated with each other through the valve casing 63 by the movement of the valve body 64. The high-pressure gas is introduced from the first conduit C to the suction pipe 16*b*, and the second cylinder chamber 14*b* becomes the high pressure. Since the vane chamber 22*b* is also in the high-pressure state, the vane 15*b* is not moved. Therefore, the half-capacity operation in which only the first cylinder chamber 14*a* is effective is performed.

Thus, the four-way selector valve for use in switching the cooling operation and the heating operation in the heat-pump type refrigerating cycle apparatus can directly be adopted as the constituent for the pressure switching mechanism Kb1, the influence exerted on the cost is suppressed, and the reliability is secured. In the four-way selector valve 60, the closed pipe E is closed by fitting the tap body Z in the front-end opening. However, the closed state is not limited to the fourth embodiment. For example, the front-end opening may be closed by simply crushing, or the front-end opening may be closed by other appropriate closing means.

Fifth Embodiment

Figure 8:
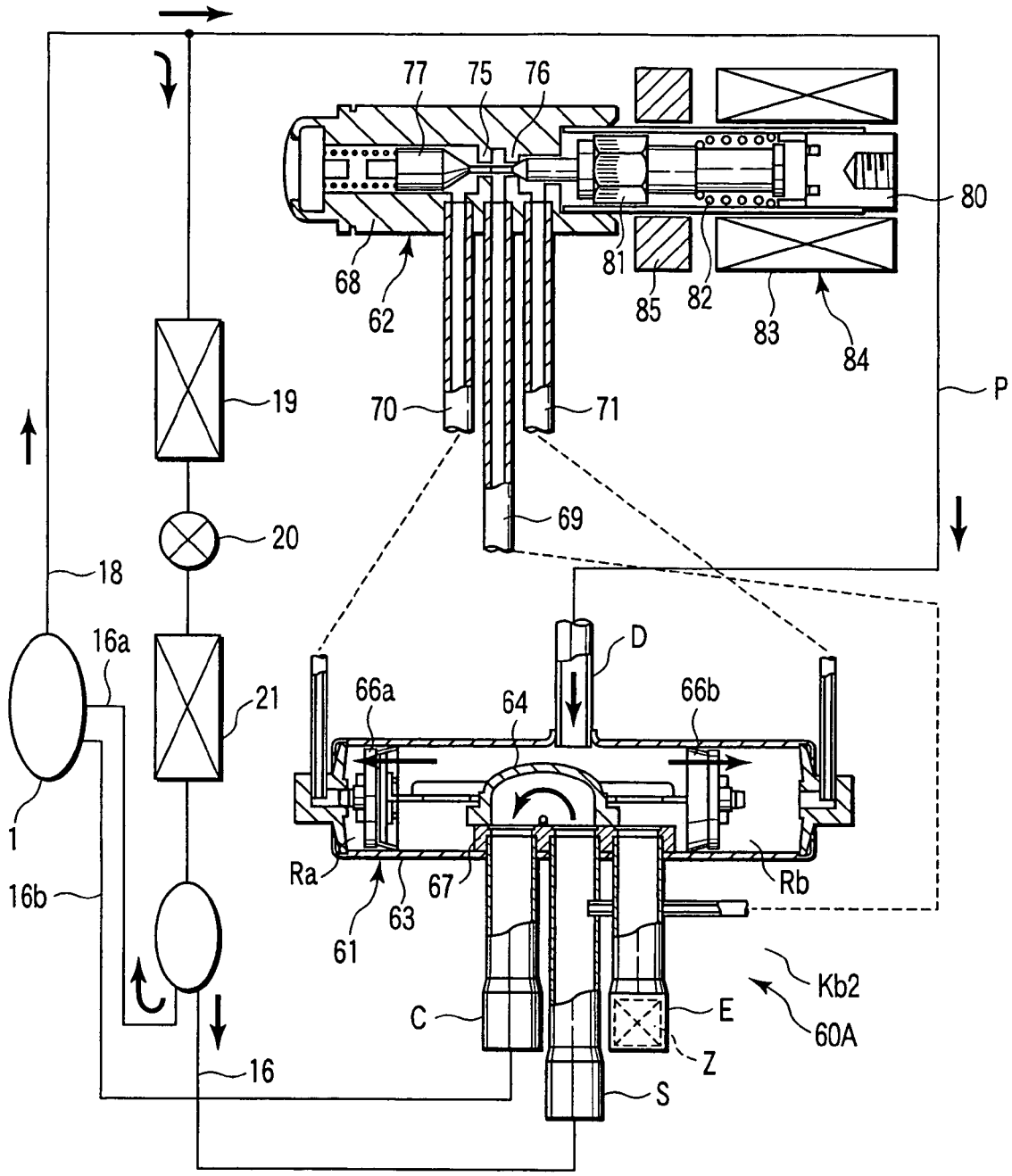
FIG. 8 is a view showing a configuration of a four-way selector valve according to a fifth embodiment of the invention, and is also a view showing a configuration of a refrigerating cycle.

FIG. 8 is a view for explaining a configuration of a pressure switching mechanism Kb2 in a fifth embodiment. The rotary closed type compressor R and the refrigerating cycle have the same configurations as the above-described first embodiment, they are indicated by the same numerals and the descriptions will be omitted. Basically, the pressure switching mechanism Kb2 has the exactly same four-way selector valve as the pressure switching mechanism Kb1 described in the fourth embodiment except for the later-mentioned region, so that the same component is indicated by the same numeral and the descriptions will be omitted.

The fifth embodiment has the feature that a permanent 85 is attached to the sub-valve 62 constituting a four-way selector valve 60A. The permanent magnet 85 is located between the sub-valve main body 68 and the magnet coil 83 constituting the solenoid 84, and the permanent magnet 85 has predetermined magnetic attraction to affect on the movable iron core 81. Specifically, the magnetic attraction of the permanent magnet 85 to the movable iron core 81 is set so as to be larger than the elastic force of the spring 82 to the movable iron core 81 while being less than the electromagnetic attraction of the solenoid 84 to the movable iron core 81.

FIG. 8 shows the state in which the overall-capacity operation is selected. The positive polarity or negative polarity is given to the solenoid 84 in the sub-valve 62 by the passage of the current through the solenoid 84, which allows the movable iron core 81 and the needle valve 77 to be moved leftward. Then the current passing through the solenoid 84 is interrupted. In the state of things, the magnetic attraction of the permanent magnet 85 acts on the movable iron core 81 to hold the positions of the movable iron core 81 and the needle valve 77. Even if a fluctuation in pressure is generated in the low-pressure gas flowing through the opened valve seat 75, the permanent magnet 85 holds the positions of the movable iron core 81 and the needle valve 77 to prevent the fluctuation in position of the needle valve 77.

When the half-capacity operation is selected (not shown), the opposite polarity to that shown in FIG. 6 is applied to the solenoid 84 by the passage of the current through the solenoid 84. The movable iron core 81 is moved against the elastic force of the spring 82 and the magnetic attraction of the permanent magnet 85 by the action of the solenoid 84. As described above in FIG. 7, the needle valve 77 opens the one valve seat 76 and closes the other valve seat 75. When the position of the needle valve 77 is determined, the solenoid 84 is changed to the non-conductive state. Although the elastic force of the spring 82 acts on the movable iron core 81 again, the magnetic attraction of the permanent magnet 85 overcomes the elastic force of the spring 82 to hold the movable iron core 81 at the position. Accordingly, the half-capacity operation is performed without any problem.

Thus, the permanent magnet 85 is included in the predetermined region of the sub-valve 62, the solenoid 84 is caused to become tentatively the conductive state in each time when the overall-capacity operation or the half-capacity operation is selected, and then the solenoid 84 is caused to become the non-conductive state again to give the influence of the magnetic attraction of the permanent magnet 85. Therefore, the influence exerted on the running cost can be suppressed at the minimum.

Sixth Embodiment

Figure 9:
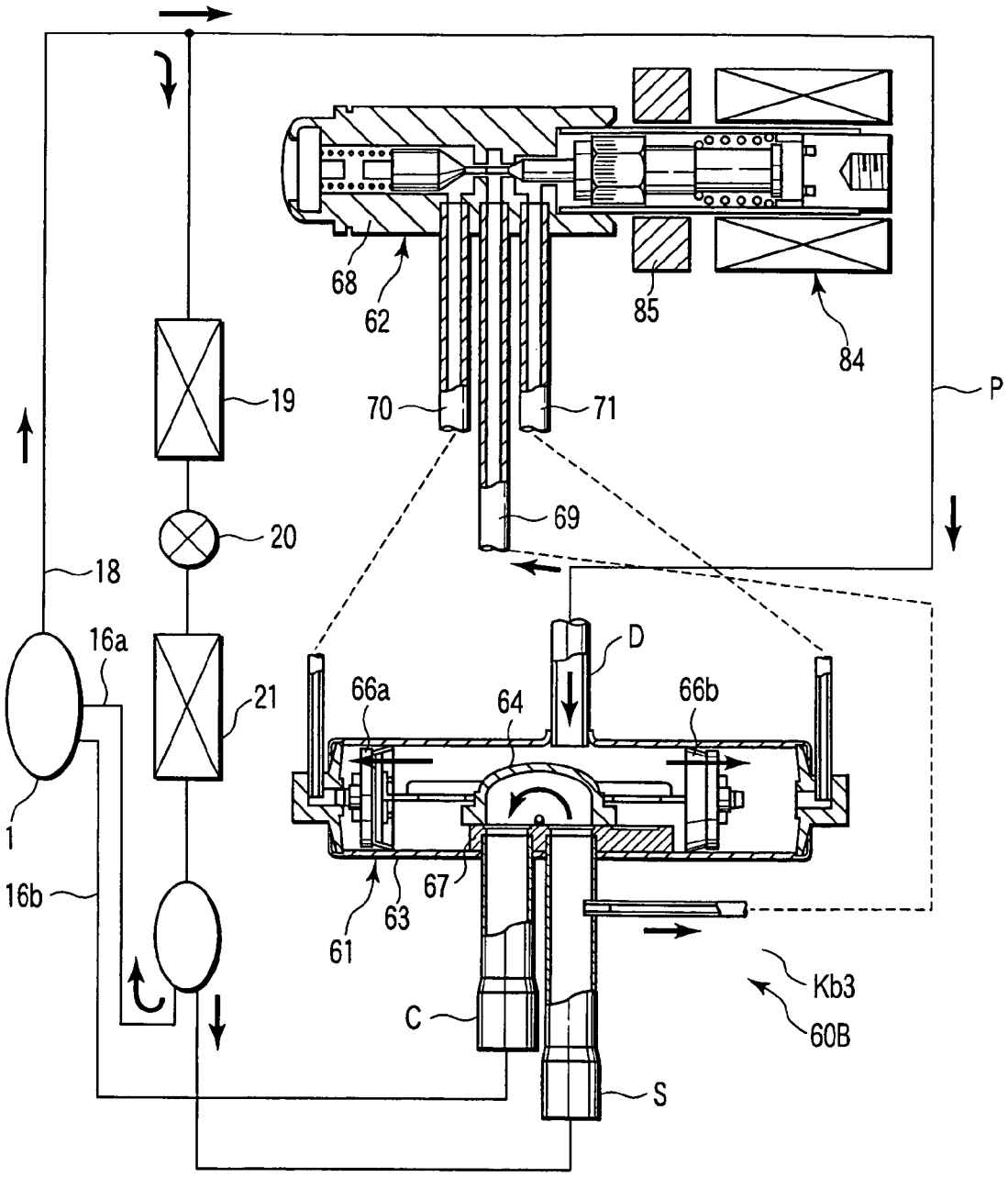
FIG. 9 is a view showing a configuration of a four-way selector valve according to a sixth embodiment of the invention, and is also a view showing a configuration of a refrigerating cycle.

FIG. 9 is a view for explaining a configuration of a pressure switching mechanism Kb3 of a sixth embodiment. The rotary closed type compressor R and the refrigerating cycle have the same configurations as the above-described first embodiment, they are indicated by the same numerals and the descriptions will be omitted. Basically, the pressure switching mechanism Kb3 includes a three-way selector valve 60B which has the exactly same configuration as the four-way selector valve 60A described in the fifth embodiment except for the later-mentioned region, so that the same component is indicated by the same numeral and the descriptions will be omitted. The configuration of the four-way selector valve 60 described in the fourth embodiment can also be applied to the sixth embodiment.

The three-way selector valve 60B has the feature that the second conduit E is removed from the main valve 61 constituting the four-way selector valve 60. In the above-described second conduit E, one end of the second conduit E is connected to the valve seat 67, but the other opening end is closed by fitting the tap body Z in the opening end, so that the second conduit E is not required at all as the flow-path configuration. It is an unavoidable measure because the widely-spread, commercially-available four-way selector valve is directly used. Thus, the three-way selector valve 60B of the sixth embodiment is configured by omitting the machining of the hole portion required for the connection to the second conduit E in producing the valve casing 63 constituting the four-way selector valve 60A.

Seventh Embodiment

In the rotary closed type compressor R including any one of the above-described pressure switching mechanisms K, Ka, Kb, Kb1, Kb2, and Kb3, the position of the vane 15*b* on the second cylinder 8B side may be held during the half-capacity operation.

Figure 10A:
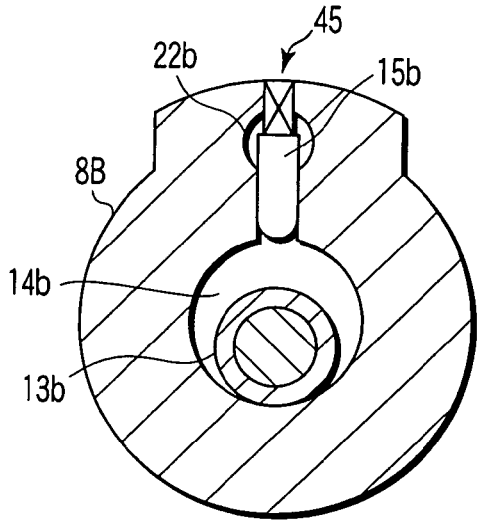
FIGS. 10A and 10B are horizontal plan views of a second cylinder according to a seventh embodiment of the invention, for explaining different holding mechanisms.
Figure 10B:
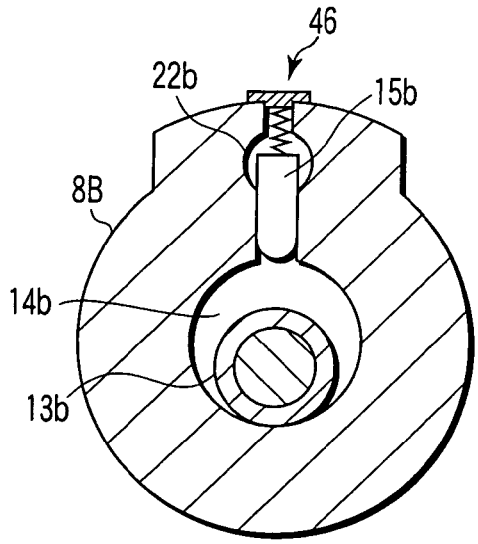

FIGS. 10A and 10B are a transverse cross-sectional view of the second cylinder 8B in a seventh embodiment. The second cylinder 8B includes holding mechanisms 45 and 46 which are different from each other. Namely, each of the holding mechanisms 45 and 46 biases and holds the vane 15*b* toward the direction in which the vane 15*b* is separated from the eccentric roller 13*b* with the force smaller than the pressure difference between the pressure applied to the second cylinder chamber 14*b* on the second cylinder 8B side and the pressure applied to the vane chamber 22*b*.

The holding mechanism 45 shown in FIG. 10A is a permanent magnet provided in the end face on the back face side of the vane 15*b*. The vane 15*b* is always magnetically attracted with a predetermined force by including the permanent magnet 45. Alternatively, it is also possible that the holding mechanism 45 includes an electromagnet instead of the permanent magnet to perform the magnetic attraction if necessary.

The holding mechanism 46 shown in FIG. 10B is formed by a tension spring which is of the elastic body. One end portion of the tension spring 46 may be hooked over the back-face end portion of the vane 15*b* to always pull and bias the vane 15*b* with a predetermined elastic force. The holding mechanism 45 or 46 biases the vane 15*b* with the set magnetic attraction or tension elastic force toward the direction in which the vane 15*b* is separated from the eccentric roller 13*b*. Accordingly, the holding mechanisms 45 and 46 do not adversely affect on the reciprocal movement of the vane 15*b* during the overall-capacity operation.

During the half-capacity operation, the holding mechanisms 45 and 46 bias the vane 15*b* so as to hold the front end portion of the vane 15*b* at the position near the top dead center where the front end portion enters and retreats from the circumferential wall of the cylinder chamber 14*b*. Namely, the vane 15*b* is held in the direction in which the vane 15*b* is separated from the eccentric roller 13*b*. Even in the half-capacity operation, the eccentric roller 13*b* is also eccentrically rotated in the second cylinder chamber 14*b*, and idling is performed. Even if the circumferential wall of the eccentric roller 13*b* reaches the position of the top dead center of the vane 15*b* where the circumferential wall faces the front end portion of the vane 15*b*, the vane 15*b* is held by the holding mechanisms 45 and 46, so that the front end portion does not come into contact with the eccentric roller 13*b*.

Assuming that the vane 15*b* is in a completely free state while the holding mechanisms 45 and 46 are not included, the front end portion of the vane 15*b* is repeatedly in contact with the eccentric roller 13*b*, which jumps the vane 15*b* in the vane chamber 22*b*. Accordingly, when the holding mechanisms 45 and 46 are not included, there are fears that abnormal sound is generated by the contact of the vane 15*b* with the eccentric roller 13*b* and breakage of the vane 15*b* is caused. However, the above troubles can be removed by including the holding mechanisms 45 and 46.

In the seventh embodiment, the first cylinder chamber 14*a* and the second cylinder chamber 14*b* have the same diameter and the same displacement. However, the invention is not limited to the seventh embodiment. For example, the first cylinder chamber 14*a* and the second cylinder chamber 14*b* may be formed so as to have the different displacements. In this case, the displacement of the first cylinder chamber 14*a* may be larger than that of the second cylinder chamber 14*b*, or, on the contrary, the displacement of the second cylinder chamber 14*b* may be larger than that of the first cylinder chamber 14*a*. Not only the switching between the overall-capacity operation and the half-capacity operation but also the switching operation at an arbitrary capacity can be performed by setting the various kinds of dimensions.

The above-described pipe P is branched from the midstream portion of the discharge pipe 18 connected to the closed case 1. However, the invention is not limited to the configuration of the pipe P described in the above embodiments. For example, as shown only in FIG. 1 by a chain double-dashed line, it is possible that the pipe P is connected to the closed case 1. Further, since it is necessary that the pipe P is connected to the high-pressure side of the refrigerating cycle, actually the pipe P may be branched from the midstream portion of the discharge pipe 18 which communicates the closed case 1 and the expansion mechanism 20.

Eighth Embodiment

The above-described rotary closed type compressors are naturally used so as to form the refrigerating cycle shown in FIG. 1. In addition, the air compressor constituting the heat pump type refrigerating cycle can be used to perform the switching operation between the overall-capacity operation and the half-capacity operation during the heating operation and the cooling operation.

In the air compressor constituting the heat pump type refrigerating cycle, as described later, the switching operation can be also performed.

Figure 11:
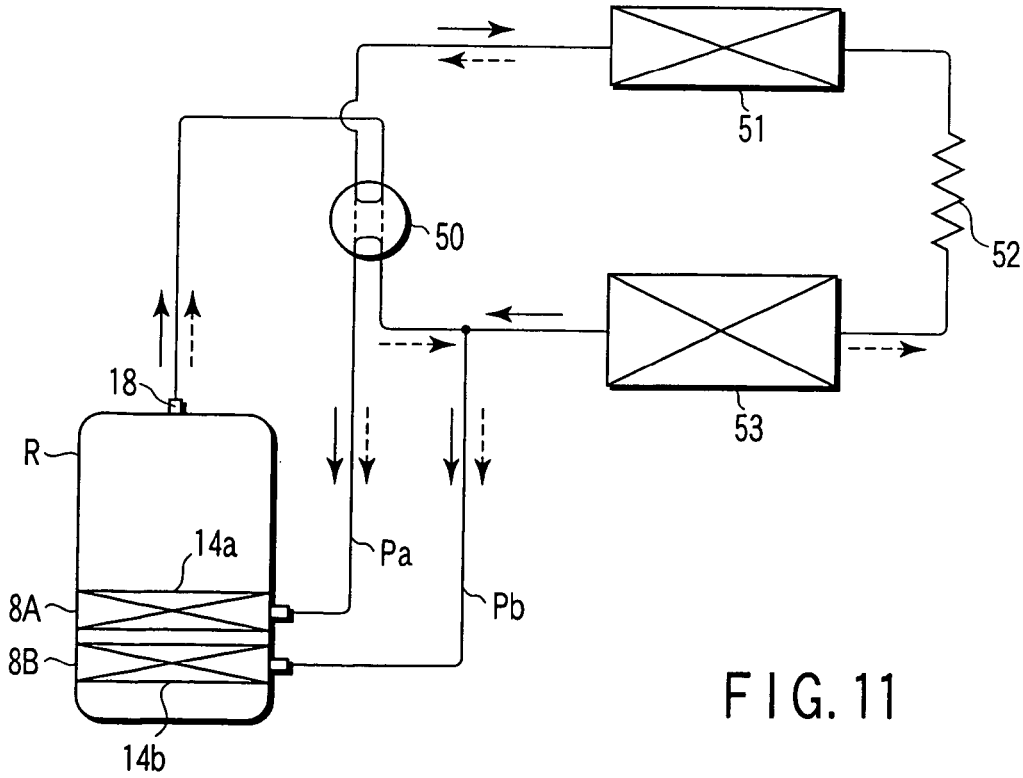
FIG. 11 is a view showing a configuration of a heat-pump type refrigerating cycle according to an eighth embodiment of the invention.

FIG. 11 is a block diagram of a heat pump type refrigerating cycle which includes the rotary closed type compressor R as an eighth embodiment. All the rotary closed type compressors R described in above embodiments can be used as the rotary closed type compressor R of the eighth embodiment. The heat pump type refrigerating cycle is formed by sequentially providing a four-way selector valve 50, an interior heat exchanger 51, an expansion mechanism 52, and an exterior heat exchanger 53 in the discharge pipe 18 connected to the compressor R.

Further, there is provided a circuit Pa which is directly connected to the cylinder chamber 14*a* of the first cylinder 8A in the compressor R through the four-way selector valve 50. There is also provided a circuit Pb which is branched from the midstream portion of the refrigerant pipe which communicates the exterior heat exchanger 53 and the four-way selector valve 50, and which is directly connected to the cylinder chamber 14*b* of the second cylinder 8B.

Generally, the heating operation requires the capacity larger than that of the cooling operation. Therefore, the switching operation of the four-way selector valve 50 is performed such that the refrigerant is introduced in the direction indicated by a solid-line arrow of FIG. 11 during the heating operation and the refrigerant is introduced in the direction indicated by a broken-line arrow during the cooling operation. In both the heating operation and the cooling operation, i.e. irrespective of the switching direction of the four-way selector valve 50, the suction pressure is always introduced into cylinder chamber 14*a* in the first cylinder 8A, and the compression action is continued by the above-described elastic force of the spring member 26.

During the heating operation, the low-pressure vaporized refrigerant derived from the exterior heat exchanger is introduced to the cylinder chamber 14*b* in the second cylinder 8B by the switching operation of the four-way selector valve 50, which generates the pressure difference between the cylinder chamber 14*b* and the high-pressure vane chamber 22*b*. Accordingly, the vane 15*b* on the second cylinder 8B side is reciprocally moved to perform the compression action. Naturally the compression action is also performed in the first cylinder chamber 8A, so that the overall-capacity operation is performed.

During the cooling operation, according to the switching operation of the four-way selector valve 50, the high-pressure gas introduced from the discharge pipe 18 is divided into the exterior heat exchanger 53 and the second cylinder chamber 14*b*. Accordingly, the second cylinder chamber 14*b* becomes the high pressure, and the vane chamber 22*b* is in the high-pressure state. Therefore, the pressure difference is not generated between the front end portion and the rear end portion of the vane 15*b*, and the compression action is not performed. Consequently, the compression action is performed only by the first cylinder chamber 14*a*, so that the half-capacity operation is performed.

The rotary closed type compressor and the refrigerating cycle apparatus including the rotary closed type compressor are not limited to the above-described configurations, and various modifications could be made without departing from the spirit and scope of the invention.

According to the invention, based on the rotary closed type compressor including the first cylinder and the second cylinder, the rotary closed type compressor, in which a pressing and biasing structure is simplified for the vane of one of the cylinders to reduce the number of components and the machining labor hour and reliability is improved, and a refrigerating cycle apparatus including the rotary closed type compressor can be obtained.

What is claimed is:

1. A rotary closed type compressor in which an electric motor unit and a rotary compression mechanism unit coupled to the electric motor unit are housed in a closed case and the closed case is caused to be in a high-pressure state by tentatively discharging gas compressed by the compression mechanism unit into the closed case, wherein the electric motor unit is received in an upper portion of the closed case, and the rotary compression mechanism unit is received in a lower portion of the closed case; and the compression mechanism unit comprises:

a first cylinder and a second cylinder having cylinder chambers, respectively, an eccentric roller being housed in the cylinder chamber while being eccentrically rotatable;

vanes which are provided in the first cylinder and the second cylinder, respectively, each of the vanes being pressed and biased such that a leading edge of said each of the vanes comes into contact with a circumferential surface of the eccentric roller, said each of the vanes dividing a corresponding one of the cylinder chambers into two sections along a rotating direction of the eccentric roller;

vane chambers in which back-face side end portions of the vanes are housed, respectively;

a spring member provided in the vane chamber on a first cylinder side which urges the vane provided in the first cylinder toward the eccentric roller; and a pressure switch mechanism which introduces suction pressure or discharge pressure to the cylinder chamber of the second cylinder;

a vane chamber on a second cylinder side opens to an interior of the closed case to permit high pressure in the closed case to be directly introduced into the vane chamber on the second cylinder side;

wherein the vane provided in the first cylinder is pressed and biased by a spring member provided in the vane chamber on the first cylinder side;

the vane provided in the second cylinder is pressed and biased according to a pressure difference between a case internal pressure introduced to the vane chamber on the second cylinder side and suction pressure introduced to the cylinder chamber of the second cylinder when the pressure switch mechanism introduces the suction pressure to the cylinder chamber of the second cylinder;

the leading edge of the vane of the second cylinder is urged to be brought into contact with a peripheral surface of the eccentric roller only by a difference between the case internal pressure introduced to the vane chamber on the second cylinder side and the suction pressure introduced to the cylinder chamber of the second cylinder, when the pressure switch mechanism introduces the suction pressure to the cylinder chamber of the second cylinder; and the case internal pressure introduced to the vane chamber on the second cylinder side is balanced with the discharge pressure introduced to the cylinder chamber of the second cylinder to thereby balance pressure at the leading edge and a rear edge of the vane of the second cylinder, thereby separating the leading edge of the vane of the second cylinder from the circumferential surface of the eccentric roller when the pressure switch mechanism introduces the discharge pressure to the cylinder chamber of the second cylinder.

2. A rotary closed type compressor according to claim 1, wherein the pressure switch mechanism for introducing the suction pressure or the discharge pressure to the cylinder chamber of the second cylinder comprises:

a branch pipe connected to a suction pipe which communicates with a high-pressure side of a refrigerating cycle and the second cylinder chamber, the branch pipe having a first on-off valve in a midstream portion of the branch pipe; and a second on-off valve or a check valve which is provided on the upstream side of the connection portion of the branch pipe in the suction pipe.

3. A rotary closed type compressor according to claim 1, wherein the pressure switch mechanism for introducing the suction pressure or the discharge pressure to the cylinder chamber of the second cylinder comprises a three-way selector valve having ports connected to the branch pipe which is connected to the high-pressure side of refrigerating cycle, a guide pipe which derives and guides vaporized low-pressure gas, and the suction pipe which communicates with the second cylinder chamber, respectively.

4. A rotary closed type compressor according to claim 3, wherein the three-way selector valve is one obtained by closing one of passages of a four-way selector valve.

5. A rotary closed type compressor according to claim 4, wherein the four-way selector valve comprises: a cylindrical valve casing; a high-pressure pipe, a low-pressure pipe and a pair of conduits which are connected to an intermediate portion of the valve casing; a pair of pistons which are housed in the valve casing while being slidable along an axial direction of the valve casing; a main valve in which a valve body is housed, the valve body causing the high-pressure pipe to communicate with one of the pair of conduits according to movement of the piston, and causing the low-pressure pipe to communicate with the other of the pair of the conduits; and a sub-valve which controls slide of the pair of pistons housed in the main valve, the high-pressure pipe is connected to the branch pipe, the low-pressure pipe is connected to the guide pipe, one of the pair of conduits is connected to the suction pipe, and the other conduit is closed.

6. A rotary closed type compressor according to claim 3, wherein the three-way selector valve comprises: a cylindrical valve casing; a high-pressure pipe, a low-pressure pipe and a conduit which are connected to an intermediate portion of the cylindrical valve casing; a pair of pistons which are housed in the cylindrical valve casing while being slidable along an axial direction of the cylindrical valve casing; a main valve in which a valve body is housed, the valve body causing the high-pressure pipe or the low-pressure pipe to communicate with the conduit according to the movement of the piston; and a sub-valve which controls the slide of the pair of pistons housed in the main valve, the high-pressure pipe is connected to the branch pipe, the low-pressure pipe is connected to the guide pipe, and the conduit is connected to the suction pipe.

7. A rotary closed type compressor according to claim 1, wherein a holding mechanism is provided in the vane chamber on the second cylinder side, the holding mechanism biasing the vane of the second cylinder with force smaller than the pressure difference between pressure in the second cylinder and pressure in the vane chamber on the second cylinder side in a direction in which the vane of the second cylinder is separated from the eccentric roller, the pressure difference being assumed when the suction pressure is introduced to the cylinder chamber of the second cylinder.

8. A rotary closed type compressor according to claim 7, wherein the holding mechanism is any one of a permanent magnet, an electromagnet, and an elastic body.

9. A rotary closed type compressor according to claim 1, wherein the first cylinder chamber and the second cylinder chamber have different displacements.

10. A refrigerating cycle apparatus wherein a refrigerating cycle is configured of a rotary closed type compressor according to claim 1, a condenser, an expansion mechanism, and an evaporator.

* * * * *